US006773097B2

(12) United States Patent
Dowell

(10) Patent No.: US 6,773,097 B2
(45) Date of Patent: Aug. 10, 2004

(54) INK DELIVERY TECHNIQUES USING MULTIPLE INK SUPPLIES

(75) Inventor: Daniel D Dowell, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 240 days.

(21) Appl. No.: 09/942,819

(22) Filed: Aug. 29, 2001

(65) Prior Publication Data

US 2003/0043240 A1 Mar. 6, 2003

(51) Int. Cl.[7] ..... B41J 2/175
(52) U.S. Cl. ..... 347/85
(58) Field of Search ..... 347/85, 86, 87; 222/56, 187

(56) References Cited

U.S. PATENT DOCUMENTS

| | | | | |
|---|---|---|---|---|
| 4,920,362 A | | 4/1990 | Cowger | 347/87 |
| 5,742,311 A | | 4/1998 | Koitabashi et al. | 347/86 |
| 6,019,459 A | | 2/2000 | Pew et al. | |
| 6,250,747 B1 | | 6/2001 | Hauck | |
| 6,398,353 B1 | * | 6/2002 | Tsuchii | 347/86 |

FOREIGN PATENT DOCUMENTS

| | | | |
|---|---|---|---|
| EP | 711 667 | * | 5/1996 |
| JP | 07323562 | | 12/1995 |
| JP | 11058772 | | 3/1999 |
| WO | WO/9742035 A | | 11/1997 |

OTHER PUBLICATIONS

European Search Report re EP 02255741, mailed Aug. 20, 2003 (3 pages).

Patent Abstracts of Japan, vol. 1999, No. 8, Jun. 30, 1999, re JP 11058772 (1 page abstract).

Patent Abstracts of Japan, vol. 1996, No. 4, Apr. 30, 1996, re JP 07323562 (1 page abstract).

* cited by examiner

*Primary Examiner*—Michael Nghiem

(57) ABSTRACT

An inkjet printing system, which includes a printhead having a plurality of ink ejection elements, a first ink supply having a capillary material disposed therein for holding a volume of ink and fluidically coupled with the printhead, and a second ink supply having a volume of ink and fluidically coupled with the printhead. The second ink supply provides ink to the printhead when a differential pressure between the printhead and the second supply exceeds a predetermined pressure.

20 Claims, 12 Drawing Sheets

INK DELIVERY TECHNIQUES USING MULTIPLE INK SUPPLIES

TECHNICAL FIELD OF THE DISCLOSURE

This invention relates to ink delivery techniques for ink-jet printing.

BACKGROUND OF THE DISCLOSURE

A capillary material such as polyurethane foam is commonly used to maintain backpressure in ink-jet pens. Although this material works well for this purpose, it tends to limit the performance capability of the ink delivery system. During printing, ink is extracted from the foam and the backpressure in the pen increases. The rate at which the backpressure increases depends on the rate of extraction. Print quality suffers if the backpressure increases too quickly, so the allowable ink flux through a foam-based ink delivery system is inherently limited.

Another disadvantage inherent to foam is extraction efficiency. Limiting the ink flux through a foam-based ink-delivery-system will control the rate at which the backpressure increases, but it will not stop the magnitude of the backpressure from increasing. If the backpressure magnitude gets too high, the nozzles will deprime and the pen will fail to print. Unfortunately, the maximum allowable backpressure is reached before all of the ink is extracted from the foam. Foam-based ink delivery systems have been implemented as disposable pens and on-axis replaceable ink supplies, but the inefficiency of both systems increases the cost per printed page. Additionally, when a foam-based replaceable ink supply is separated from the pen, nozzle backpressure and environmental compliance is lost. In this state, light impact or environmental changes may cause the pen to drool. Regulators and spring bags are used to maintain backpressure and provide environmental compliance in ink-jet pens, but these systems result in higher direct material cost and increased manufacturing complexity. Also, these systems are sealed and will eventually become full of air, resulting in pen failure.

SUMMARY OF THE DISCLOSURE

An inkjet printing system is described, which includes a printhead having a plurality of ink ejection elements, a first ink supply having a capillary material disposed therein for holding a volume of ink and fluidically coupled with the printhead, and a second ink supply having a volume of ink and fluidically coupled with the printhead. The second ink supply provides ink to the printhead when a differential pressure between the printhead and the second supply exceeds a predetermined pressure.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE DISCLOSURE

Figure 1A:
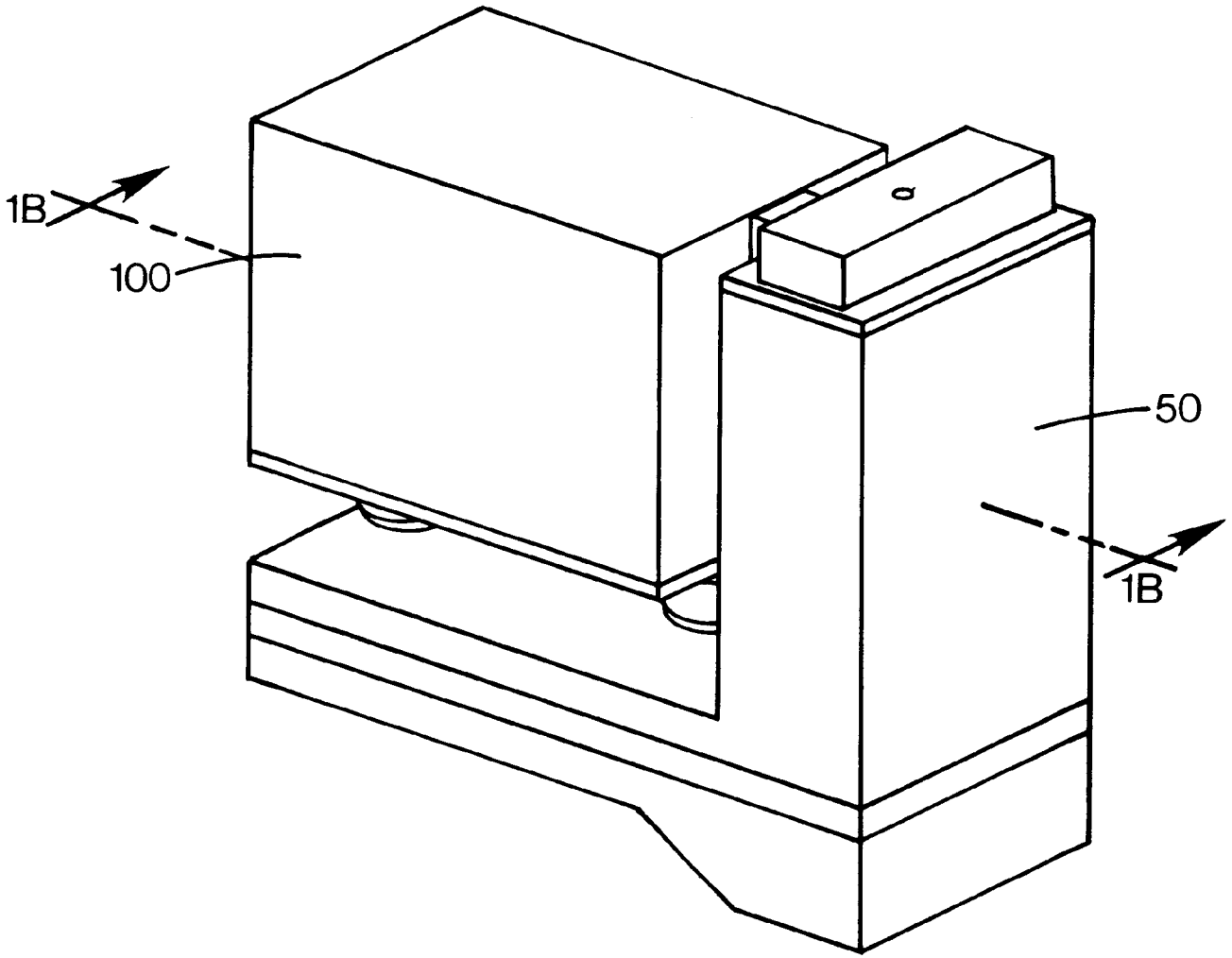
FIG. 1A is an isometric view illustrative of an exemplary embodiment of an ink delivery system for an ink-jet print cartridge in accordance with aspects of the invention.
Figure 1B:
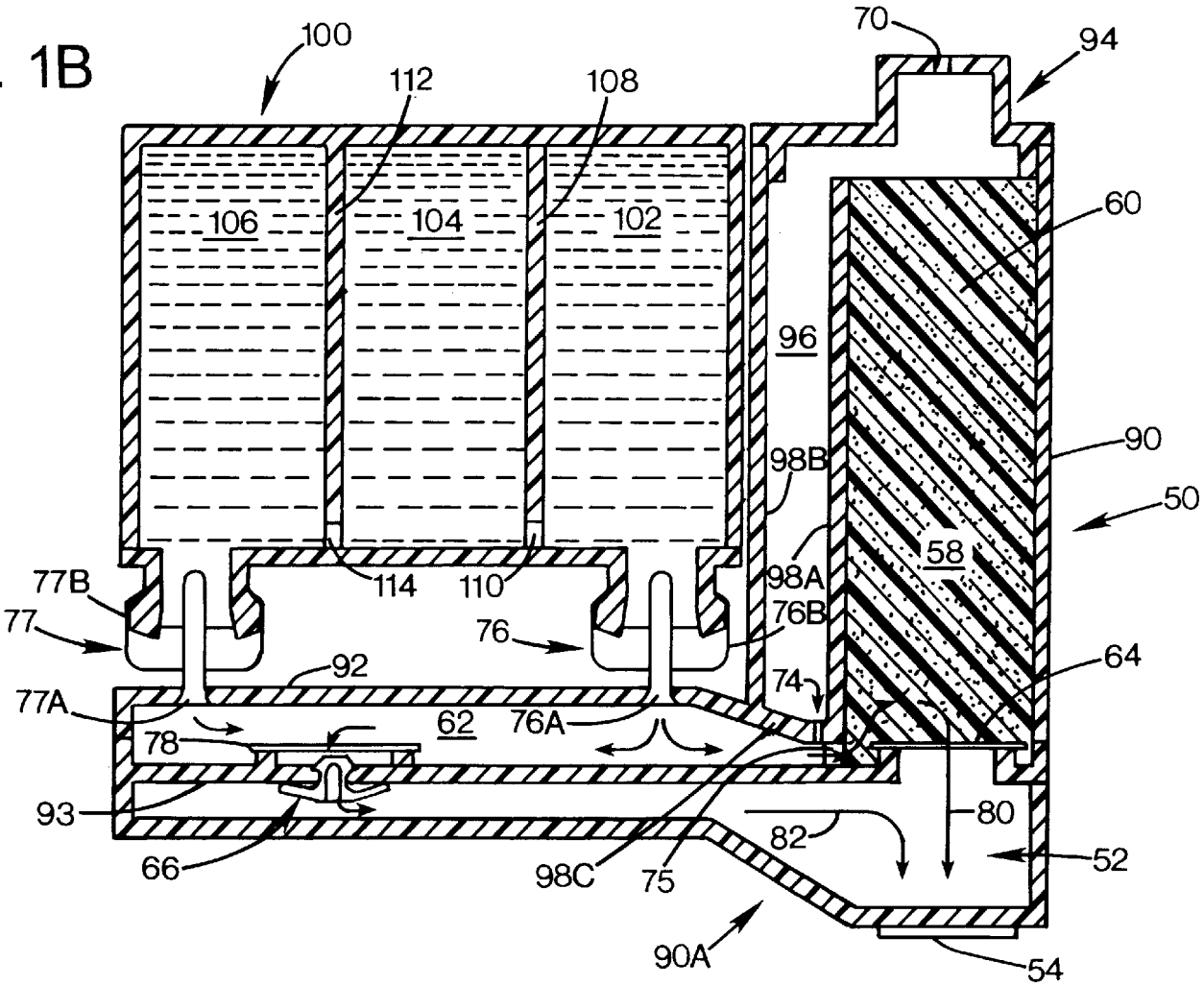
FIG. 1B is a diagrammatic cross-sectional view of the system of FIG. 1A.

FIGS. 1A–1B shows an illustrative embodiment of an ink delivery system for ink-jet printing. This exemplary embodiment is an on-axis replaceable ink-delivery system for an ink-jet pen 50; i.e. the ink delivery system is typically carried on a traversing carriage with the pen. However, this invention is also applicable for disposable and off-axis replaceable ink-delivery-systems.

The pen 50 has a body structure 90 which defines a snout region 90A and a wall 92. A printhead 54 is mounted on the snout region 90A, and typically comprises a nozzle array and circuitry for activating the nozzle array. The pen 50 includes a standpipe 52 and the printhead 54 that are separated from a foam chamber 58 and a free ink chamber 62 by a filter 64 and check valve 66, respectively. The filter 64 can be fabricated of a fine metal mesh, for example. The check valve 66 is fitted in an opening in a mid-plate 93, and can be an elastomeric umbrella-type check valve, although other types of fluid control devices could alternatively be substituted, such as a poppet valve, or even an electromechanical valve.

The foam chamber 58 has disposed therein a body of capillary material, in this example a high capillarity foam body 60. The use of foam structures in ink jet pens is well known. Other types of capillarity structures could also be employed, such as a body of bonded polyester fibers, for example.

The body structure 90 includes an internal wall 98A that separates the capillary chamber 58 from an open chamber 96 defined generally between internal wall 98A and external wall 98B. A bottom wall 98C separates the open chamber 96 from the free ink chamber 62. The capillary chamber 58 and the open chamber 96 are vented to atmospheric pressure via a labyrinth vent 70 formed in cap member 94. The vent allows the capillary chamber and the open chamber 96 to ingest or expel air as necessary while protecting the ink against excessive water loss due to evaporation.

A coupling orifice 74 is formed in bottom wall 98C, in communication with the free ink chamber 62 and the open chamber 96. The diameter of the orifice is relatively small, e.g. on the order of 0.5 mm, with an orifice length on the order of 1 mm (i.e. the thickness of wall 98C) in an exemplary embodiment.

The free ink chamber 62 has provided therein two fluid interconnect structures 76A and 77A each comprising half of a respective resealable make-break fluid interconnect 76, 77, and a second filter 78. Two fluid interconnects are employed in this exemplary embodiment, one of which will carry ink and the other air.

In this exemplary embodiment, the interconnects 76, 77 comprises needle/septum interconnects, of the type described in more detail in U.S. Pat. No. 5,815,182, the entire contents of which are incorporated herein by this reference. Thus, structures 76A, 77A are hollow needle structures mounted on wall 92. Of course, other types of make-break interconnects can alternatively be employed, for example, a sliding seal formed by a spring-loaded ball that is displaced by a needle.

An opening 75 is formed in wall 98A between the free ink chamber 62 and the capillary chamber 58. A typical dimension for the opening is 2 mm high by 1 mm wide. The opening 75 provides a fluid pathway for ink to flow from the free chamber 62 to the foam chamber 58. The open chamber 96 provides space to accommodate air bubble expansion in free ink chambers comprising the system. As air bubbles expand, they will tend to displace free ink, which can be displaced into the chamber 96, and also through opening 75 into chamber 58.

The ink delivery system further includes an ink supply 100 with fluid interconnect structures 76B, 77B defining the other half of the resealable make-break fluid-interconnect 76, 77. The ink supply 100 has one or more free ink chambers; three chambers 102, 104, 106 are provided in the exemplary embodiment of FIGS. 1A–1B. Each free ink chamber is separated from the other by a dividing wall and an opening. Thus, chambers 102 and 104 are separated by a wall 108 having an opening 110 formed therein. Chambers 104 and 106 are separated by a wall 112 having an opening 114 formed therein. The openings 110, 114 can have size on the order of opening 75, i.e. 2 mm high by 1 mm wide in one exemplary embodiment.

The replaceable ink cartridge 100 allows the user to replace the ink supply for the pen 50, which can lower the cost of ownership, since the pen 50 is not replaced as often, if at all.

During operation, ink is ejected from the printhead 54 through the nozzles of the nozzle array comprising the printhead. If the rate of ejection is low, the change in standpipe backpressure is small and the check valve 66 remains closed. Ink is pulled from the capillary chamber 58, through the filter 64, and into the standpipe 52, along a primary ink supply path 80. As the ink is ejected, the capillary forces in the capillary material 60 draw ink from the ink supply into the free ink chamber 62, through the opening 75, replenishing the capillary reservoir. As this occurs, a pressure differential between the ink supply (comprising the free ink in chamber 62 and the ink in supply 100) and the open chamber 96 develops, and the magnitude continues to increase until an air bubble is pulled through the coupling orifice 74 into the free ink chamber 62, and into the ink supply 100. Once the bubble passes, the pressure differential is eliminated and the process repeats as required.

Consider now the case when the rate of ink ejection from the printhead 54 is high. The change in standpipe backpressure is large enough to exceed the break pressure of the check valve 66, and the check valve opens. In an exemplary embodiment, the break pressure of the check valve is on the order of 4 to 5 inches of water. Once the valve 66 opens, this allows ink to flow from the ink supply 100, through the second filter 78, and into the standpipe 52, along a secondary ink supply path 82, bypassing the capillary chamber 58 completely. As with the relatively low ejection rate, a pressure differential between the free ink supply and the open chamber 96 develops, causing an air bubble to pass through the coupling orifice 74 and into the free ink chamber 62. Bubble buoyancy is used to help direct the bubble to the bottom of needle 76A, where it enters the free ink chamber 102. The bubble must find its way into the ink supply so that it can replace the volume of ink that is removed from the ink supply during printing. It is difficult to pass air and ink through the same needle, so ink is removed from the third chamber 106 through interconnect 77, and air passes from the pen 50 into chamber 102 of the ink supply through interconnect 76. As printing proceeds, ink drawn from chamber 106 will be replenished through opening 114 from chamber 104, and chamber 104 is replenished with ink drawn through opening 110 from the first chamber 102. Thus, the first chamber to be depleted of ink will be chamber 102, then chamber 104, and finally chamber 106.

Figure 2:
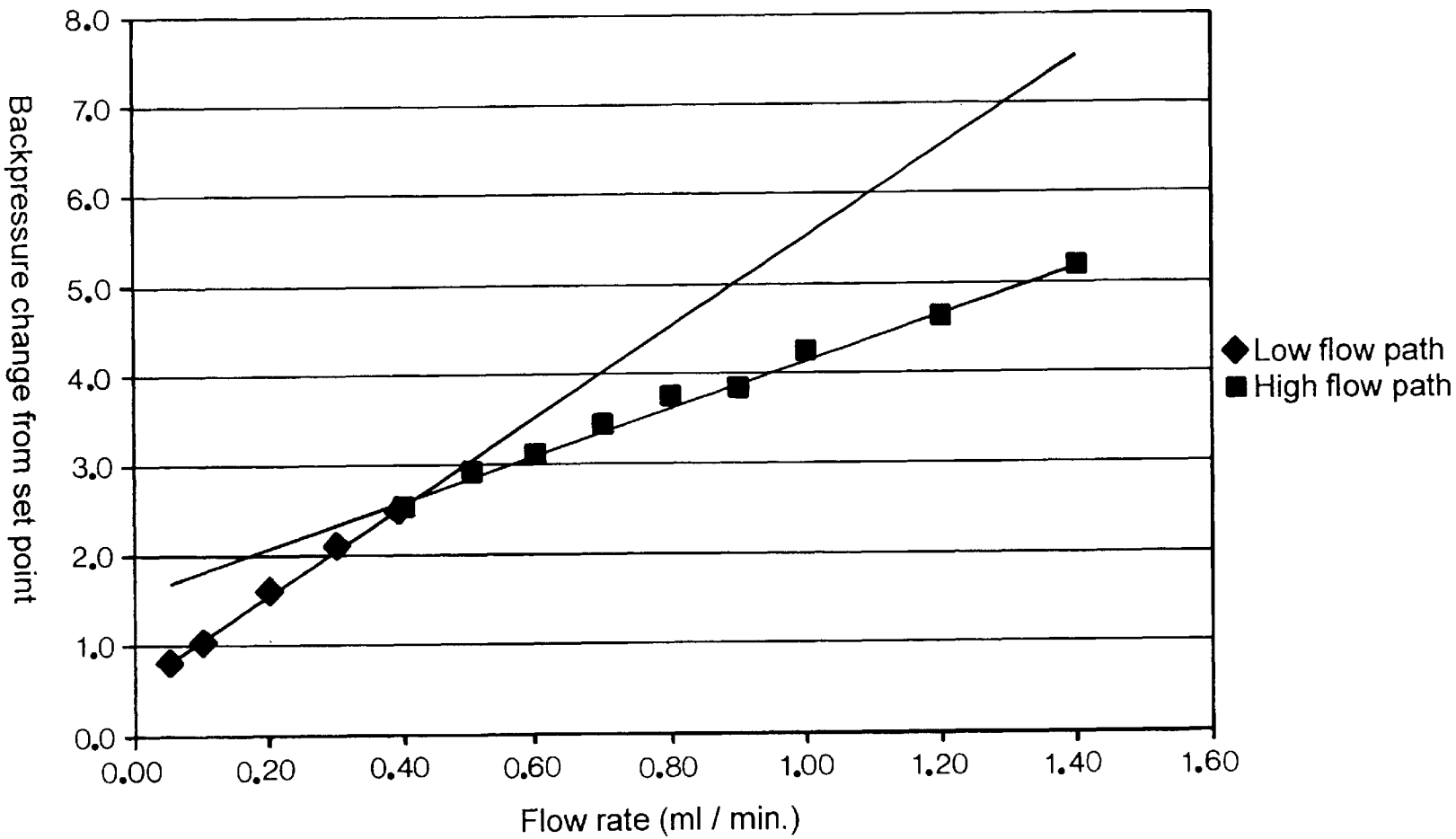

The secondary ink flow path 82 through the free ink chamber 62 does not have as much resistance to flow as the primary ink flow path 80 through the foam chamber 58, so the rate at which the standpipe backpressure changes is lessened. This means the pen can sustain higher flow rates without adversely affecting print quality. This is visually evident by plotting the change in standpipe backpressure versus flow rate for an exemplary embodiment, as illustrated in FIG. 2.

Figure 3:
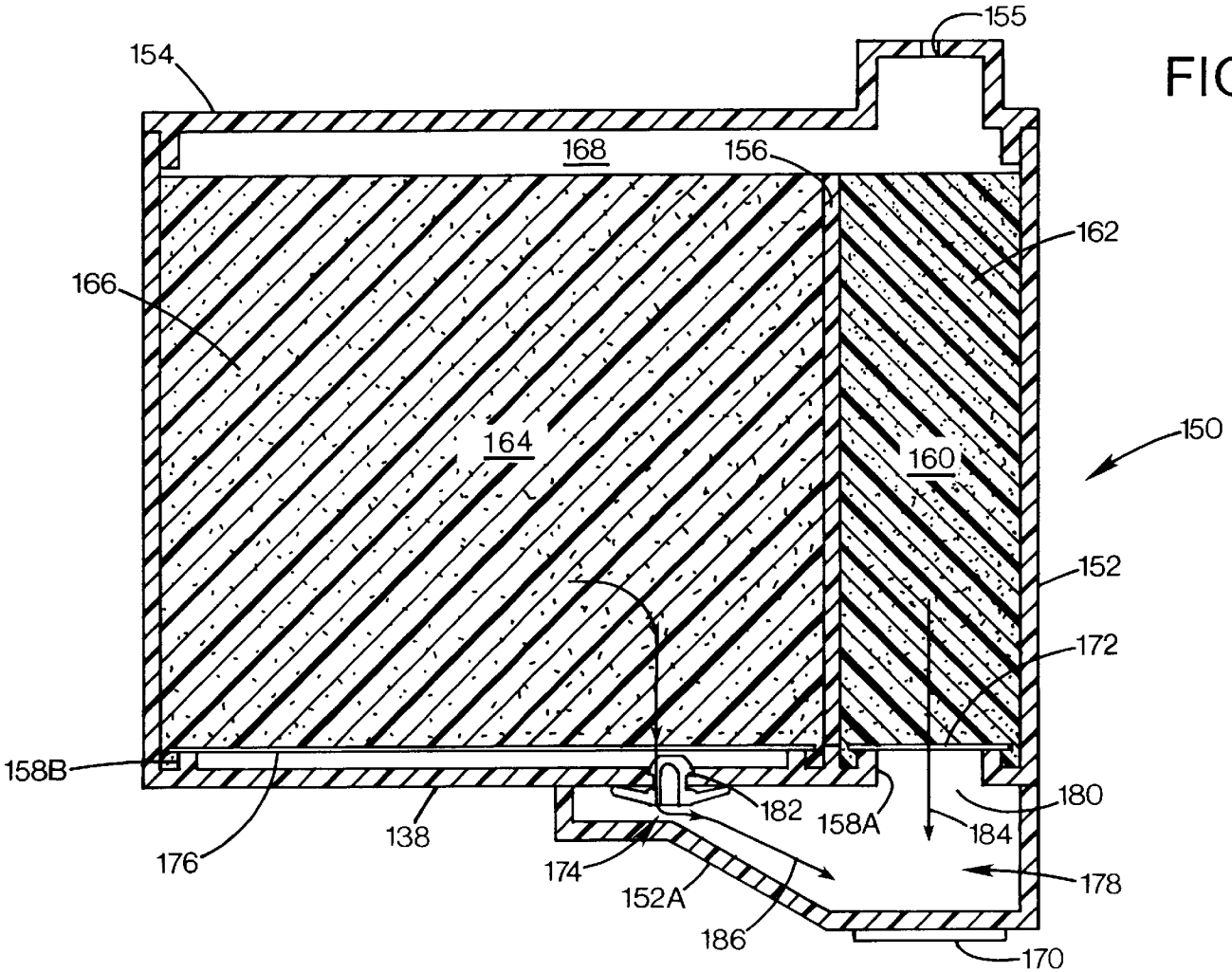

FIG. 3 illustrates another embodiment of an ink delivery system in accordance with aspects of the invention. Shown therein is a vertical cross-section through a disposable print cartridge 150, which includes a body structure 152, and a snout 152A fluidically and mechanically coupled to the bottom face of the print cartridge body structure 152. An inkjet printhead 170 is attached to the snout region 152A.

The body structure 152 includes an interior wall 156 which divides the interior space into two chambers 160, 164, each having a capillary material disposed therein. The print cartridge 150 includes two capillary materials, one having a greater capillary head than the other. In this exemplary embodiment, capillary chamber 160 has disposed therein a body 162 of high capillary head material, such as foam, while chamber 164 has disposed therein a body 166 of relatively low capillary head material. "Capillary head" is defined as the height of a liquid column that can be supported by the capillary material due to the negative pressure generated by the meniscus at the upper surface of the liquid. The capillary materials can be fabricated of foam, wherein the foam material 162 is of smaller pore size than the pore size of material 164. Alternatively, the foam could be replaced with any capillary material, such as glass beads of different diameters.

A cap structure 154 is fitted to the top of the body structure after the capillary materials 162, 166 have been disposed therein. An open space 168 is formed above the capillary bodies 162, 166, and above the top edge of the interior wall 156, providing an expansion space for air bubbles. The cap contains a vent 155 that allows the print cartridge to ingest or expel air as necessary while protecting the ink against excessive water loss due to evaporation (i.e. a labyrinth).

Chamber 160 communicates with the standpipe 178 through opening 180 in bottom wall 138. A mesh filter 172 is positioned across the opening 180 on an upstanding boss 158A. A check valve 174 is positioned in an opening 182 formed in bottom wall 158, between the standpipe 178 and the low capillarity chamber 164. A second filter 176 is positioned on upstanding boss structure 158B over the second opening.

Capillary material (such as foam) is often used to maintain backpressure in a print cartridge over its usable life. As ink is extracted from the capillary material, the static and dynamic backpressure in the standpipe will increase. Eventually, the backpressure will reach a magnitude that will deprime the printhead nozzles. Unfortunately, deprime occurs before all of the ink has been extracted from the capillary material, which makes the print cartridge volumetrically inefficient. It is desirable for the capillary material to have a low capillary head because the volumetric efficiency (volume of extractable ink divided by volume of actual ink) increases as the capillary head decreases. When printing, the backpressure in the standpipe will increase at a faster rate when high capillary material is used than it does when low capillary material is used, so high capillary material inherently limits the allowable drop ejection frequency. Conversely, materials with low capillary head are often unable to provide adequate backpressure for the printhead, especially when the material is holding a large volume of ink or if an environmental change such as temperature or altitude is encountered. These materials are also known to "lose or let go" of some of the ink when the print cartridge experiences a small impact. As a result, materials with higher capillary head are conventionally used at the expense of volumetric efficiency.

The print cartridge 150 addresses the problem by using a small amount of high capillary material 162 (such as polyurethane foam) and a large amount of low capillary material 166 (also polyurethane foam, but with larger capillaries). The high capillary material 162 communicates with the standpipe 178 through filter 172 along a primary flow path 184, and is capable of supporting the column of ink contained within it, even if a small impact occurs. The low capillary material 166 communicates with the standpipe 178 through a second filter 176 along a secondary flow path 186, but a check valve 174 is placed between the capillary material 166 and the printhead 170. The check valve 174 has a break pressure on the order of 4–6 inches of water, in an exemplary embodiment. If the print cartridge 150 were to experience an impact, the low capillary material may not be capable of supporting the columns of ink contained within it, but the check valve prevents ink from entering the standpipe, thus eliminating the risk of drool.

When the print cartridge 150 is new, both capillary chambers are full of ink and the high capillary material 162 is used to set the static backpressure in the standpipe 178. The standpipe backpressure must be kept within a specific range or print quality will suffer. During printing, this backpressure will increase. The rate at which it increases will depend upon the frequency of drop ejection and the dynamic pressure losses associated with sucking ink from the capillary material. When printing begins, ink is sucked from the high capillary material and the standpipe backpressure begins to increase. If the frequency of drop ejection is high enough, the backpressure will increase to a point where the check valve will open and ink will begin flowing from the low capillary material 166. It is easier to draw ink from the low capillary material, so the rate at which the stand pipe backpressure is increasing will slow down. This means the printhead will be capable of higher frequency drop ejection before the backpressure in the standpipe reaches the point at which print quality is compromised.

As the ink level in the high capillary material drops, the static backpressure in the standpipe will increase. Eventually, further printing will cause the ink level in the high capillary material to drop to a point where, once printing stops, the backpressure in the standpipe will still exceed the cracking pressure of the check valve. When this occurs, the high capillary material will refill from the low capillary material, passing ink from the standpipe 178 through the filter 172 into chamber 160, until the backpressure falls below the cracking pressure of the check valve. From this point forward, the check valve will set the static backpressure in the standpipe. Eventually, the ink level in the low capillary material will fall to a level where it becomes equally difficult to extract ink from both materials. When this occurs, the check valve remains open for the remaining life of the print cartridge and the standpipe backpressure will inrease until nozzle deprime occurs.

Figure 4:
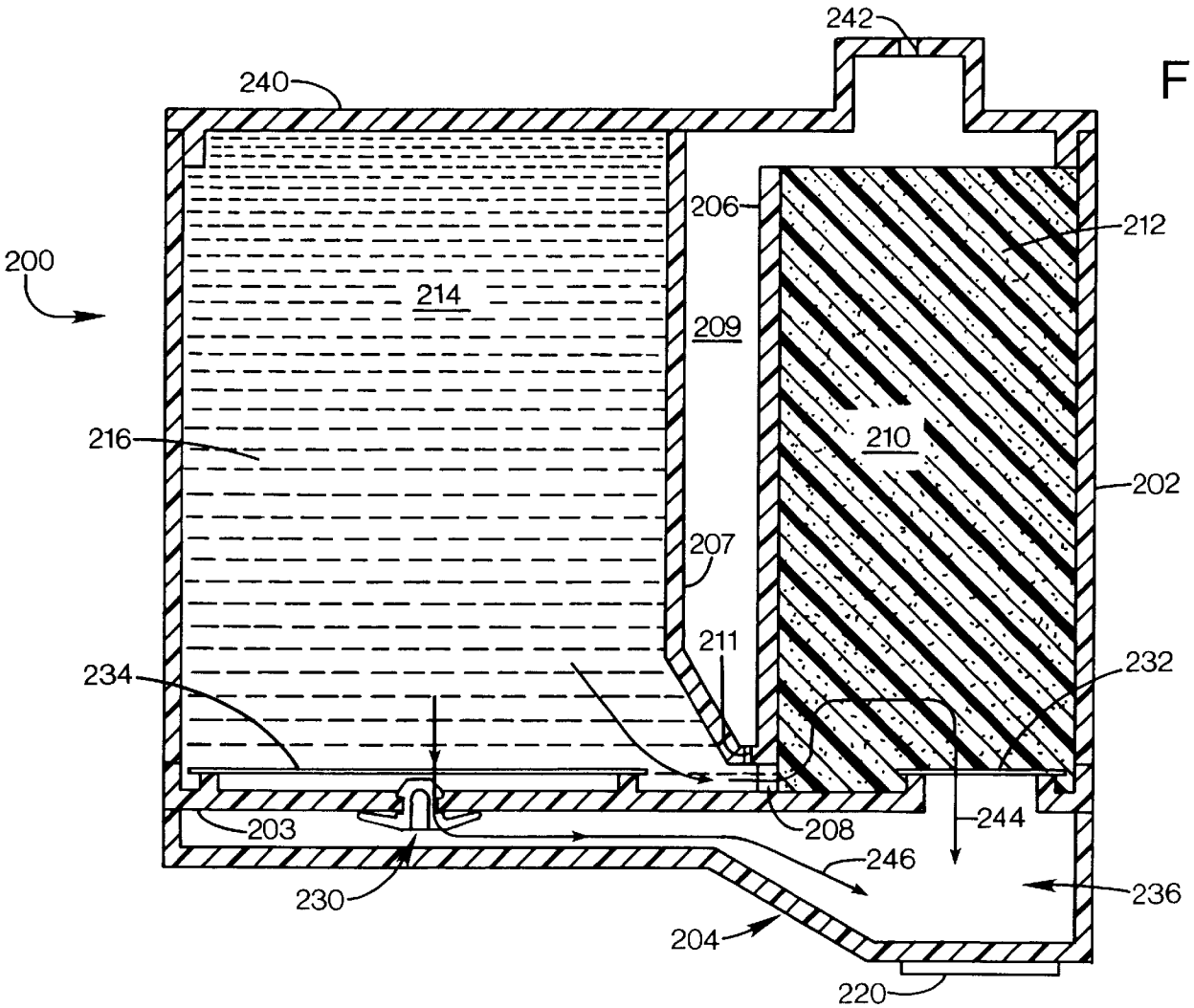

FIG. 4 illustrates a further alternate embodiment of a print cartridge embodying aspects of the invention. In FIG. 4, a disposable print cartridge 200 is disclosed, and includes a body structure 202 that defines a capillary chamber 210 and a free ink chamber 214. The capillary chamber holds a capillary material 212 (such as polyurethane foam) that communicates with the free ink chamber through an opening 208 in the wall 206 that separates the two chambers.

The print cartridge 200 includes a printhead 220, which is mounted on a snout 204. The snout is fluidically and mechanically coupled to the bottom of a mid-plate 203 comprising the body structure 202. The mid-plate supports a check valve 230 and two filters 232 and 234. The volume between the printhead 220 and the filters forms a standpipe 236. The mid-plate is fluidically and mechanically coupled to the top portion of the print cartridge body 202. A cap 240 includes a vent 242 that allows the capillary chamber 210 to ingest or expel air as necessary while protecting the ink against excessive water loss due to evaporation (i.e. a labyrinth). The free ink chamber 214 is sealed by internal wall 207.

This embodiment employs high capillary material 212 to maintain backpressure in the standpipe 236 and includes the check valve 230 for a high ink flux path 246. The free ink chamber 214 improves the volumetric efficiency of the print cartridge over the "all-foam" solution shown in FIG. 3.

During printing, the printhead will draw ink from the free ink chamber 214, through opening 208 into the high capillary material 212, through the filter 232, and into the standpipe 236, along a primary ink flow path 244. The free ink chamber is sealed by internal wall 207, so as ink is removed, the pressure inside the chamber 214 will become more negative. Eventually, the pressure will be so negative that the meniscus that is formed within the coupling orifice 211 will collapse and an air bubble will enter the free ink chamber. This is known as exceeding the bubble pressure of the coupling orifice 211. After the bubble enters the free ink chamber, the pressure returns to a point below the bubble pressure of the coupling orifice and the meniscus reforms. This process is repeated as printing continues. If at any time during printing the backpressure in the printhead nozzle exceeds the cracking pressure of the check valve 230, ink will flow directly from the free ink chamber to the standpipe along secondary ink flow path 246. This bypass reduces the rate at which the backpressure is increasing because it is less difficult to draw ink from the free ink chamber than it is to draw ink through the high capillary material.

As ink 216 is removed from the free ink chamber 214, air is ingested. The air will expand if a temperature increase or pressure decrease should occur, so the high capillary material must be capable of temporarily holding the displaced ink that results from this expansion. The sizing of the free ink chamber and the size of the capillary material is discussed below with respect to FIGS. 10–11.

FIGS. 5–9 are diagrammatic cross-sectional illustrations of another alternate embodiment of a print cartridge embodying aspects of the invention. Disposable print cartridge 250 includes a capillary chamber 284 and three free ink chambers 290, 292, 294. The capillary chamber 284 holds a capillary material 286 (such as polyurethane foam) that communicates with the first free ink chamber through an opening in the wall separating the two chambers. Likewise, each of the free ink chambers communicates with any adjacent free ink chamber through an opening 272, 274 in the wall 264, 266 separating the respective chambers.

The print cartridge includes a printhead 258, mounted to a snout 254. The snout is fluidically and mechanically coupled to the bottom of a mid-plate 256. The mid-plate supports two filters 296, 298 and a check valve 276, such as an umbrella valve, although other types of valves can alternatively be employed. The internal volume between the printhead and the filters is the standpipe 278. The mid-plate is fluidically and mechanically coupled to a print cartridge body structure 252 that includes internal walls 260, 262 which define an open region 263 therebetween, and internal walls 264, 266. A coupling orifice 270 is formed adjacent an intersection of the internal walls 260, 262 and in communication with chamber 290.

A cap 280 is connected to the top of the body structure 252, and includes a vent 282, such as a labyrinth, that allows the capillary chamber to ingest or expel air as necessary while protecting the ink against excessive water loss due to evaporation. The wall 260 is a partial wall, allowing fluid communication of open space 263 with the vent 282.

The embodiment of FIGS. 5–9 employs high capillary head material to maintain backpressure in the standpipe 278 and includes the check valve 276 providing a high ink flux path. The three free ink chambers improve the volumetric efficiency of the print cartridge over the "all foam" and "single" free ink chamber embodiments of FIGS. 2–4, because the foam can be smaller, since it only has to buffer air expansion from one (smaller) free ink chamber.

Figure 6:
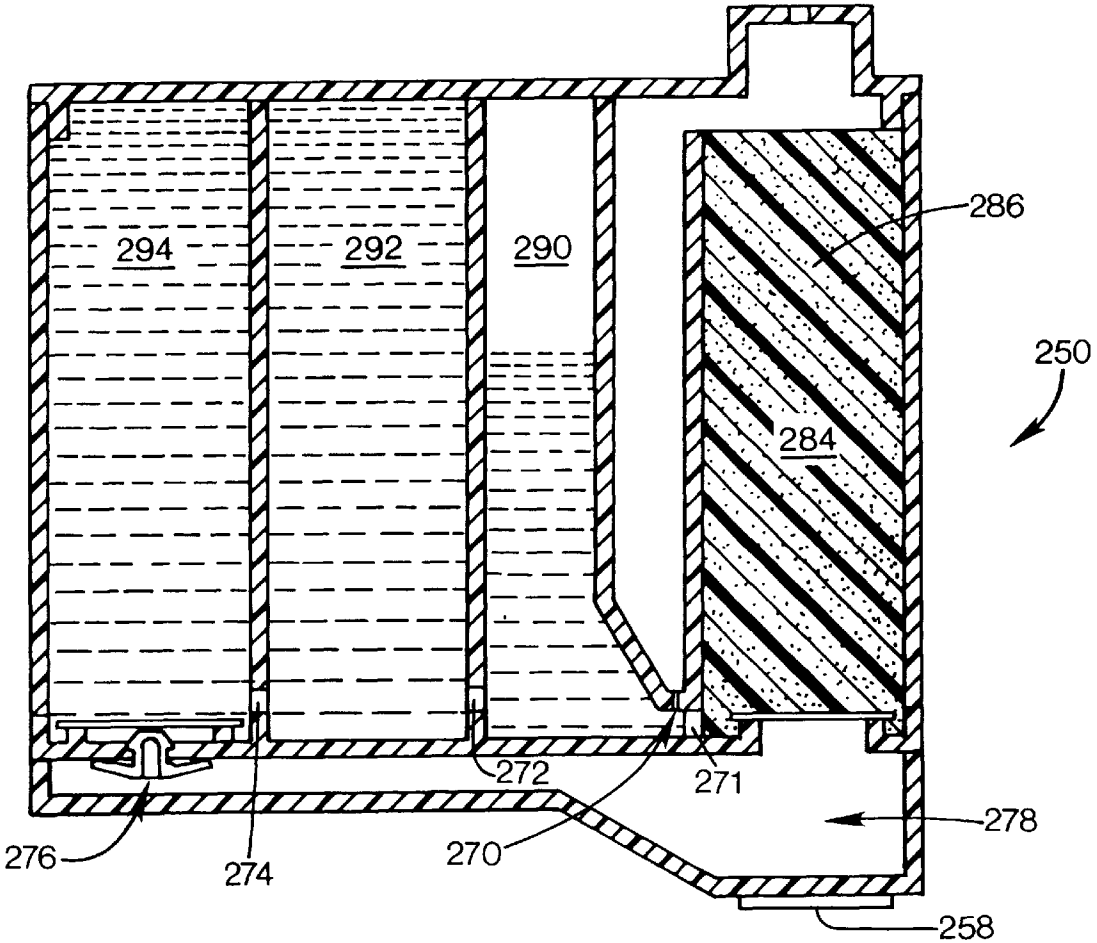
FIGS. 6–9 show the print cartridge of FIG. 5 in successive states during the life of the print cartridge.
Figure 7:
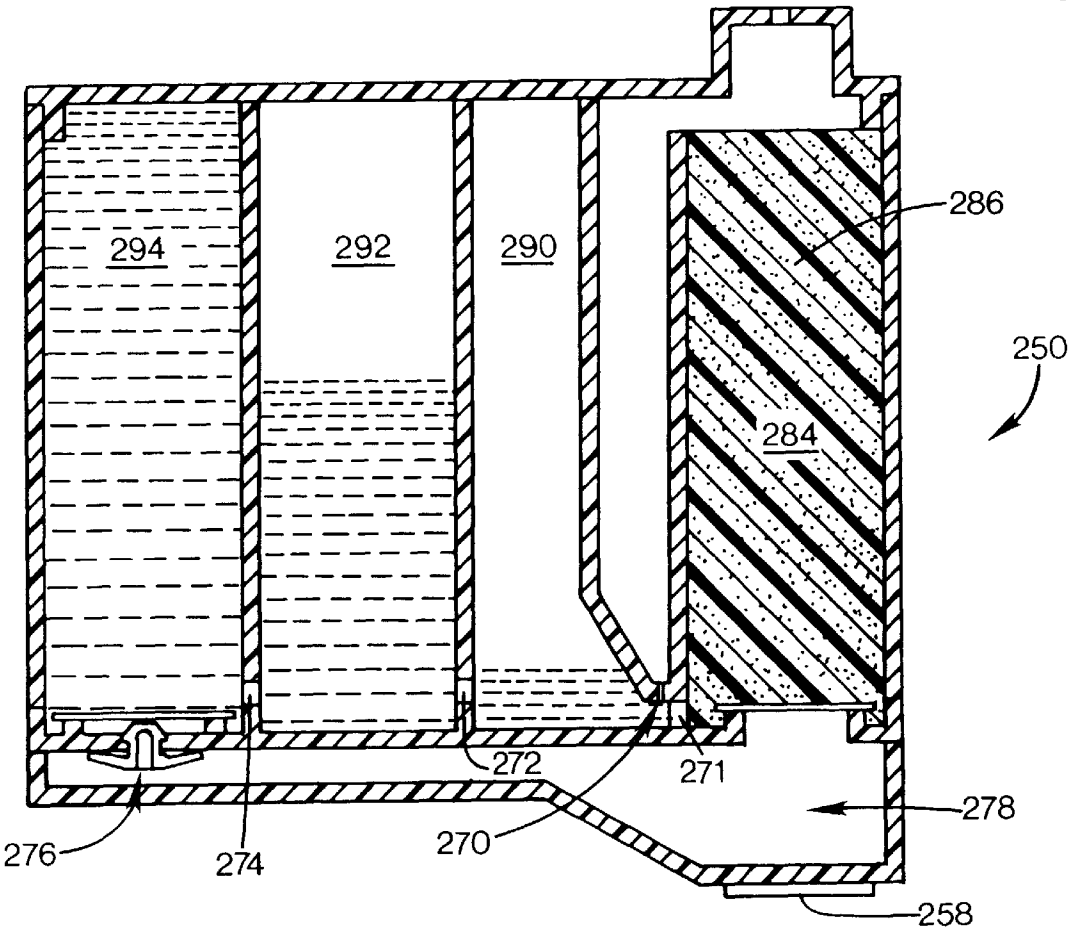
Figure 8:
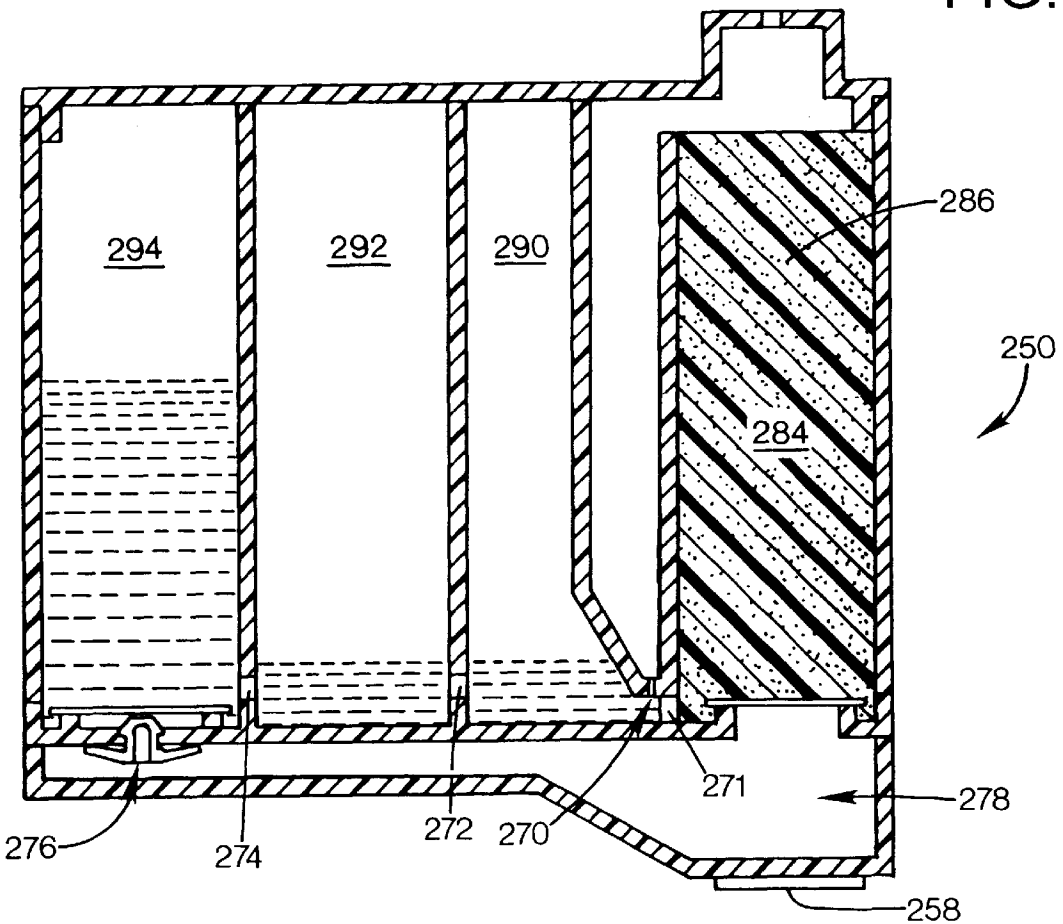
Figure 9:
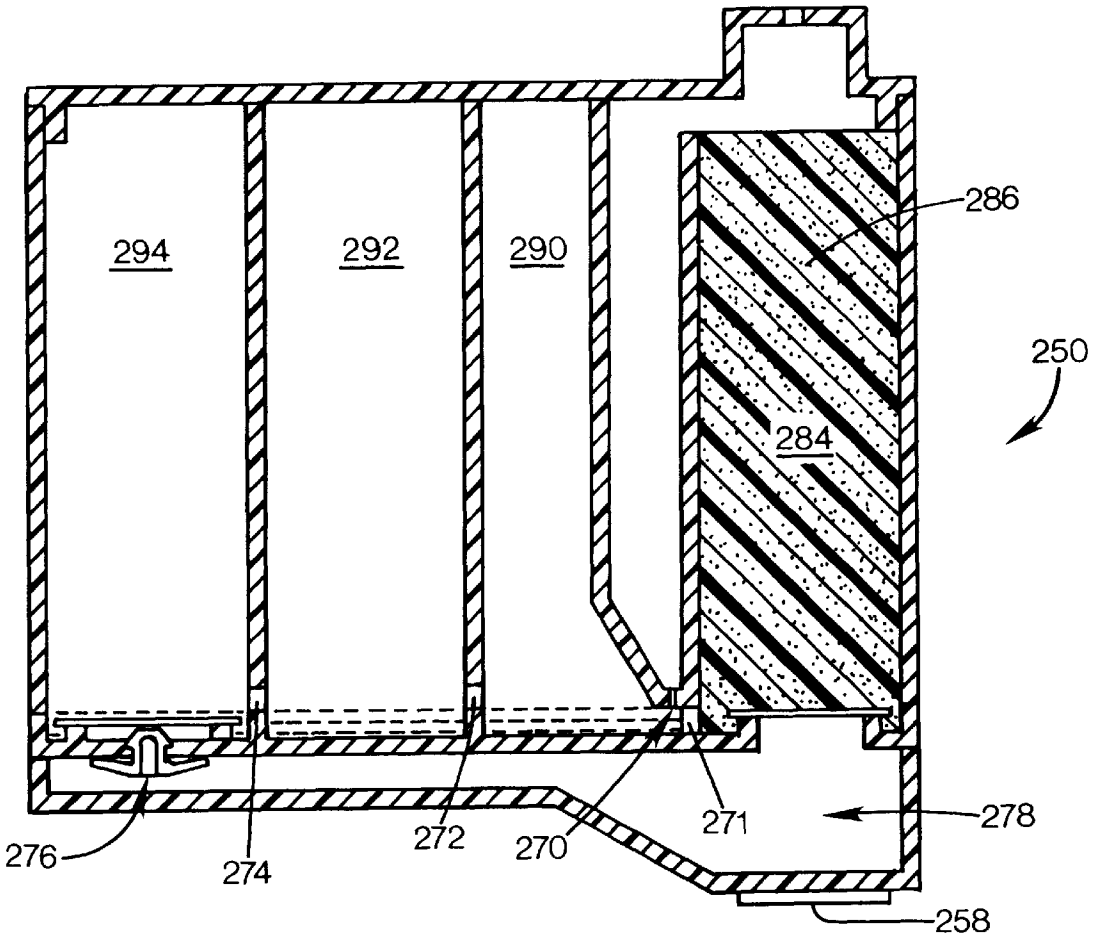

During printing, the printhead 258 will draw ink from the first free ink chamber 290, through opening 271 formed in wall 260 into chamber 284, through the high capillary material 286, through the filter 296 and into the standpipe 278. All of the free ink chambers 290, 292, 294 are sealed, the tops of the walls 262, 264, 266 being sealed to the cap 280, so that as ink is removed from the first free ink chamber 290, the pressure inside will become more negative. Eventually, the pressure will become so negative that the bubble pressure of the coupling orifice 270 is exceeded, and the meniscus that is formed within the coupling orifice will collapse and a bubble will enter the chamber 290 from the open region 263. After the bubble enters the chamber 290, the pressure returns to a point below the bubble pressure of the coupling orifice and the meniscus reforms. FIG. 6 shows the print cartridge 250 in a condition in which the chamber 290 has been partially depleted of ink. This process is repeated as printing continues until the ink level in the first free ink chamber 290 drops to a point where the opening 272 in the wall between the first and second free ink chambers is reached. Once this occurs, the ink in the second free ink chamber 292 is used during printing and air that enters the coupling orifice 270 is passed from the first free ink chamber 290 to the second free ink chamber 292 through the opening 272 in the wall that separates the two chambers. This condition of the print cartridge 250 is shown in FIG. 7. Note that there is still enough ink in the first free ink chamber 290 to keep the coupling orifice "wet" so that it still functions as a "bubbler." Similarly, the ink level in the second free ink chamber 292 will drop until the opening 274 in the wall between the second and third free ink chamber is reached. At this time, the ink in the third free ink chamber 294 is used during printing and air that enters through the coupling orifice 270 is passed to the third free ink chamber through the openings in the walls that separate the chambers. FIG. 8 shows the condition in which the ink level in chambers 290, 292 has reached the wall openings, and chamber 294 has been partially depleted of ink. FIG. 9 shows the condition in which all the free ink chambers have been depleted.

If at any time during printing, the backpressure in the standpipe 278 exceeds the cracking pressure of the check valve 276, ink will flow directly from the third free ink chamber 294 to the standpipe. This bypass reduces the rate at which the backpressure is increasing because it is less difficult to draw ink from the free ink chamber than it is to draw ink through the high capillary material 286. When ink is removed from the third free ink chamber 294, the pressure inside the chamber 294 becomes more negative and ink or air will pass from the second free ink chamber 292 to the third chamber 294. This in turn causes the pressure inside the second free ink chamber to become more negative and ink or air will pass from the first free ink chamber 290 to the second chamber 292. Removing ink or air from the first free ink chamber causes the pressure inside to become more negative until a bubble is introduced through the coupling orifice 270.

FIG. 6 illustrates that the first free ink chamber 290 will contain both air and ink at some point during the usable life of the print cartridge, while the second and third free ink chambers contain only ink. The air in the first free ink chamber will expand if a temperature increase or pressure decrease should occur, so the high capillary material should be capable of temporarily holding the displaced ink that results from this expansion. Air bubbles in the free ink chambers will be kept at the top of the chamber due to buoyancy, so when the air expands due to environmental change, the ink in the chamber is pushed out of the chamber. Only when the chamber is empty of free ink will air pass directly to the vent.

As will be explained in further detail below, the capillary material is sized in relation to the size of the free ink chamber, to buffer air expansion. However, in this embodiment, the free ink chambers are relatively small, and because only one of the free ink chambers will contain both ink and air at any given time, the size of the volumetrically inefficient capillary material is also small, in comparison to the embodiment of FIG. 4.

Figure 10:
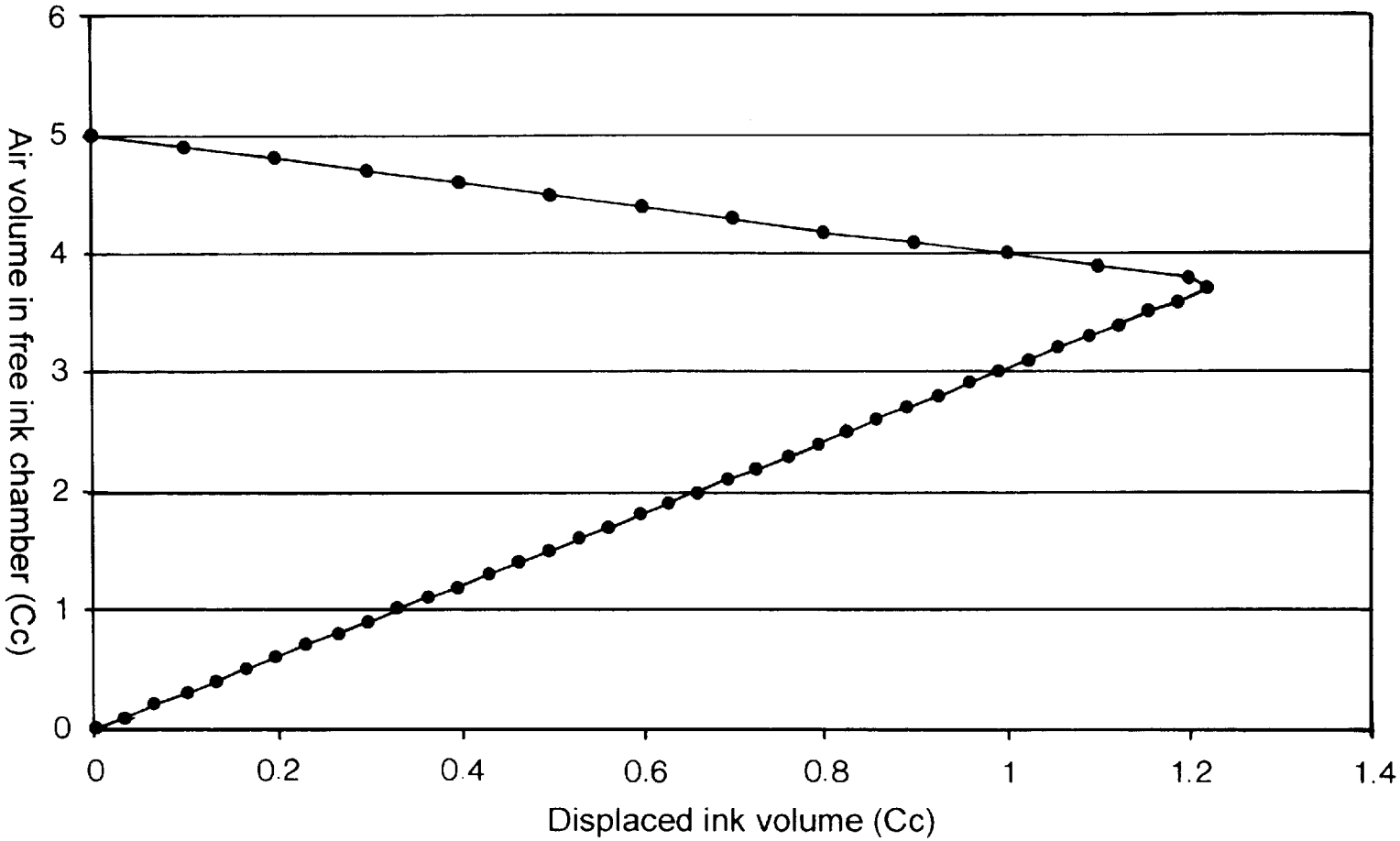
FIGS. 10–11 are graphs illustrating displaced ink volume as a function of air volume in a free ink chamber.

There is a relationship that should be maintained between the volume of capillary material and the volume of the free ink chamber for the embodiment shown in FIG. 4. The capillary material 212 acts as a temporary buffer for any ink that is displaced out of free ink chamber 214 during an altitude or temperature excursion and therefore should be sized accordingly. For example purposes assume the free ink chamber volume to be 5 cubic centimeters. During the life of the print cartridge; the volume of ink in the chamber will decrease as the volume of air in the chamber increases. The volume of ink that gets displaced during an environmental excursion depends upon how much air is in the free ink chamber. This relationship is shown in FIG. 10, which shows that the displaced ink volume reaches a maximum when the air volume in the free ink chamber is 3.7 cubic centimeters. The displaced ink volume at this point is 1.2 cubic centimeters and represents the volume that the capillary material must buffer during an environmental excursion.

Figure 5:
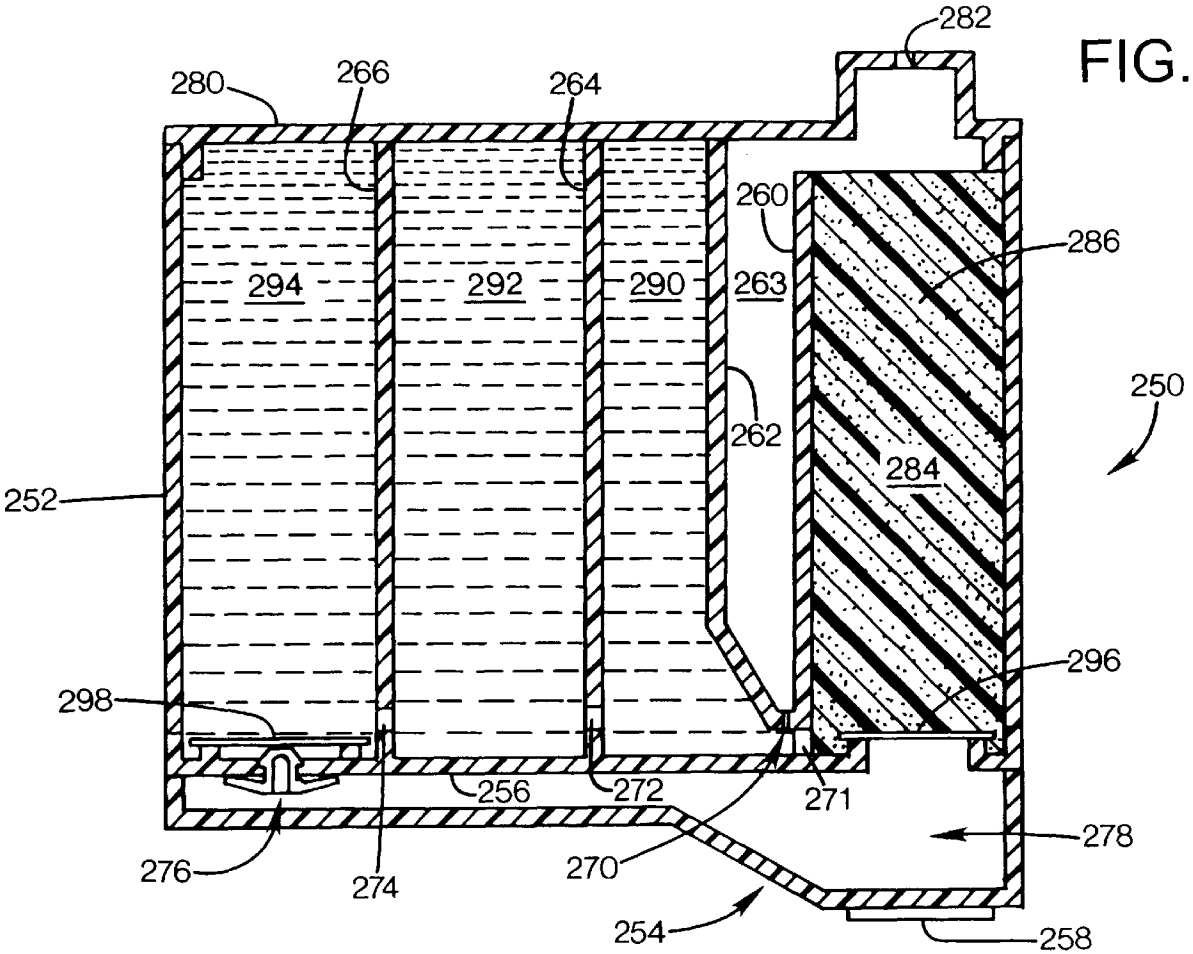
Figure 11:
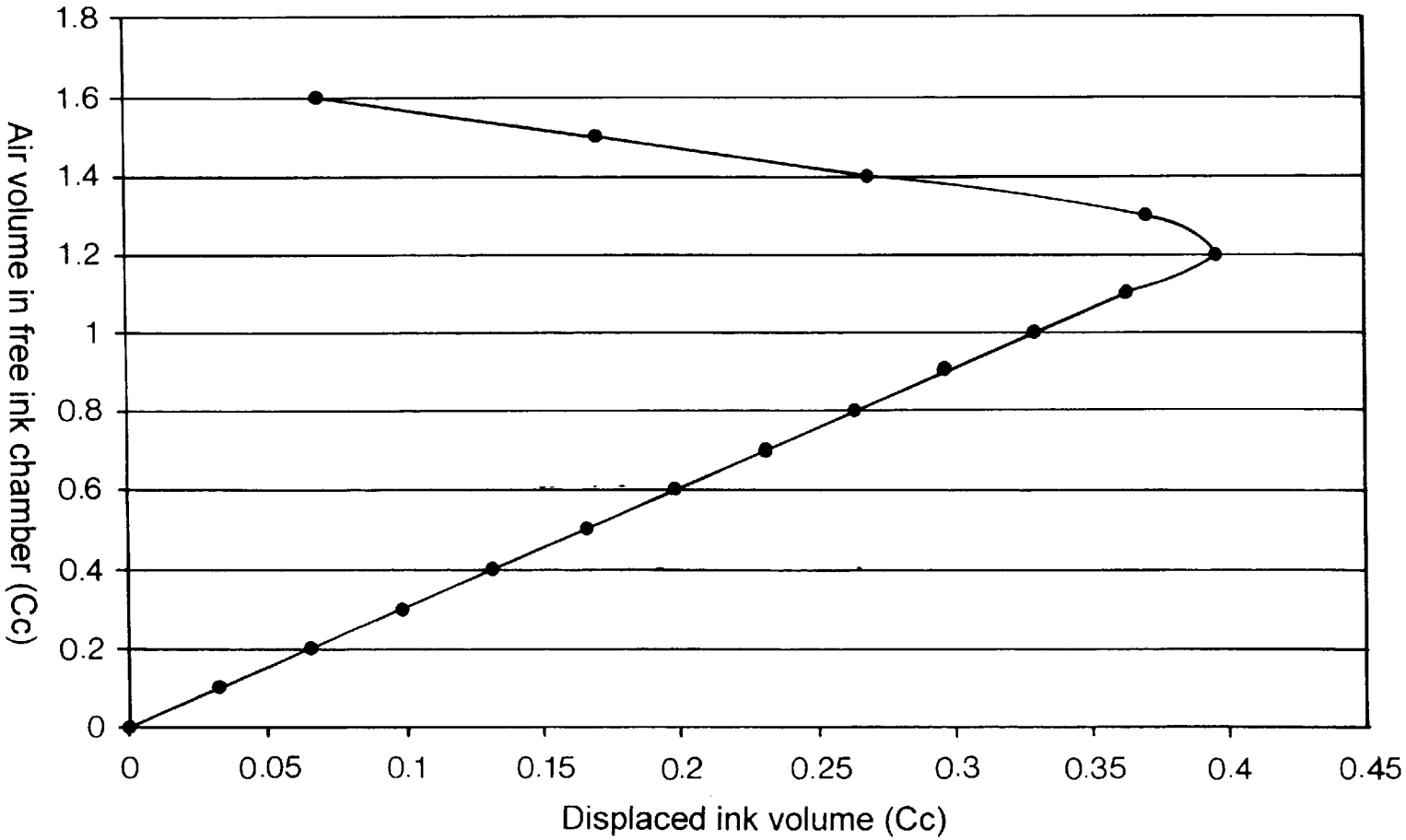

The embodiment shown in FIG. 5 is designed to reduce the size of the capillary material by reducing the buffer volume that is required. This is accomplished by replacing the single free ink chamber of the previous embodiment with three smaller free ink chambers. The order in which the ink is used from these chambers is shown in FIGS. 6–9. It is shown that only one chamber contains both air and ink during the life of the pen. This means that the buffer volume is sized relative to a smaller free ink volume and is therefore reduced. For example purposes assume that the 5 cubic centimeter volume from the previous embodiment is divided into three equal sized chambers. Each chamber would be approximately 1.67 cubic centimeters. The volume of ink that gets displaced during an environmental excursion depends upon how much air is in the free ink chamber that is currently being used by the pen. This relationship is shown in FIG. 11, which shows that the displaced ink volume reaches a maximum when the air volume in the free ink chamber is 1.2 cubic centimeters. The displaced ink volume at this point is 0.4 cubic centimeters and represents the volume that the capillary material must buffer during an environmental excursion. The buffer volume required for the smaller free ink chambers 290, 292, and 294 is ⅔ less than that of the larger free ink chamber. Because the buffer volume is smaller, the volume of capillary material 286 is also smaller and therefore the embodiment is more volumetrically efficient. If the free ink chamber 290 is the state shown in FIG. 7, the air in that chamber can escape through the vent and therefore is not accounted for in the sizing of the ink buffer. This also applies when free ink chamber 292 is in the state shown in FIG. 8.

The techniques disclosed herein enable the use of a capillary-based ink-delivery-system while improving performance capability of the print cartridge and increasing volumetric efficiency of the ink supply. Additionally, aspects of this invention increase pen robustness for on-axis replaceable ink-delivery-systems.

An advantage is the performance improvement that is gained from an alternate fluidic path that delivers ink to the printhead when high flow rate printing is required. Other capillary-based ink delivery systems use a single path, which includes the capillary material, to deliver ink to the printhead. The capillary material limits the maximum allowable ink flux and therefore limits the overall speed of the printer. By providing an alternative path, a low cost capillary material can be used for backpressure and environmental compliance, while providing performance capability of a system that is typically more expensive and more difficult to manufacture. This invention is useful for disposable, on-axis replaceable, and off-axis replaceable ink delivery systems.

Another advantage is the volumetric efficiency of the ink reservoir, specifically when implemented as on-axis replaceable or off-axis replaceable. Other systems have included the capillary material as part of the replaceable ink supply, which leaves the print cartridge in a vulnerable state when the two are separated. In one exemplary embodiment according to one aspect of this invention, capillary material provides backpressure, but it is not integrated into the replaceable ink supply. Instead, the capillary material is part of the print cartridge and the ink supply is a "free ink" design, which results in an increase in volumetric efficiency. This efficiency improvement enables smaller designs and/or lower cost per printed page.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An inkjet printing system comprising:

a printhead having a plurality of ink ejection elements;

a first ink supply having a capillary material disposed therein for holding a volume of ink and fluidically coupled with the printhead;

a second ink supply having a volume of ink and fluidically coupled with the printhead through a free ink flow path between the second ink supply and the printhead;

said second ink supply providing ink to the printhead through the free ink flow path when a differential pressure between the printhead and the second supply exceeds a predetermined pressure;

a flow control device responsive to said differential pressure, allowing ink to flow from the second ink supply to the printhead;

wherein said flow control device is a check valve.

2. An inkjet printing system comprising:

a printhead having a plurality of ink ejection elements;

a first ink supply having a capillary material disposed therein for holding a volume of ink and fluidically coupled with the printhead;

a second ink supply having a volume of ink and fluidically coupled with the printhead through a free ink flow path between the second ink supply and the printhead;

said second ink supply providing ink to the printhead through the free ink flow path when a differential pressure between the printhead and the second supply exceeds a predetermined pressure;

a flow control device responsive to said differential pressure, allowing ink to flow from the second ink supply to the printhead;

wherein said flow control device is a poppet valve.

3. An inkjet printing system comprising:

a printhead having a plurality of ink ejection elements;

a first ink supply having a capillary material disposed therein for holding a volume of ink and fluidically coupled with the printhead;

a second ink supply having a volume of ink and fluidically coupled with the printhead through a free ink flow path between the second ink supply and the printhead;

said second ink supply providing ink to the printhead through the free ink flow path when a differential pressure between the printhead and the second supply exceeds a predetermined pressure;

a flow control device responsive to said differential pressure, allowing ink to flow from the second ink supply to the printhead;

wherein said flow control device is an electro mechanical valve.

4. An ink delivery system for ink-jet printing, comprising:

a printhead including an array of nozzles for ejecting droplets of ink during printing operations;

a first ink supply chamber having a capillary body disposed therein for holding a volume of ink negative pressure;

a second ink supply chamber for holding a volume of free ink;

a standpipe in fluid communication with the printhead;

a capillary ink flow path running from the second ink supply chamber through the first ink supply chamber and the standpipe to the printhead;

a free ink flow path running from the second ink supply chamber and the standpipe to the printhead; and a check valve disposed in said free ink flow path for selectively opening said free ink path only when an ink back pressure differential between said standpipe and said second ink supply chamber exceeds a predetermined break pressure.

5. The system of claim 4, further comprising a filter disposed in said capillary ink flow path downstream of the first ink supply chamber.

6. The system of claim 4, further comprising a filter disposed in said free ink path.

7. The system of claim 4, further comprising a pen body structure, and wherein said first and second chambers and said standpipe are integrated into said body structure, and said printhead is mounted to a printhead mounting region on said body structure.

8. The system of claim 4, wherein said capillary body comprises a body of foam.

9. The system of claim 4, further comprising a free ink supply container for holding an auxiliary supply of free ink, and a fluid interconnect structure for providing a fluid interconnect path between said container and said second ink supply chamber to allow ink replenishment.

10. The system of claim 9, wherein said free ink supply container has defined therein a plurality of fluidically coupled free ink chambers.

11. The system of claim 9 wherein said free ink supply container is fluidically coupled to the second chamber during normal printing operations.

12. The system of claim 4 further comprising a vent for venting the first ink chamber to the ambient atmosphere.

13. An inkjet printing system comprising:

a printhead having a plurality of ink ejection elements;

a first ink supply having a capillary material disposed therein for holding a volume of ink and fluidically coupled with the printhead;

a second ink supply having a volume of ink and fluidically coupled with the printhead, said second ink supply providing ink to the printhead when a differential pressure between the printhead and the second supply exceeds a predetermined pressure; and a check valve responsive to said differential pressure, allowing ink to flow from the second ink supply to the printhead.

14. An inkjet printing system comprising:

a printhead having a plurality of ink ejection elements;

a first ink supply having a capillary material disposed therein for holding a volume of ink and fluidically coupled with the printhead;

a second ink supply having a volume of ink and fluidically coupled with the printhead, said second ink supply providing ink to the printhead when a differential pressure between the printhead and the second supply exceeds a predetermined pressure; and a poppet valve responsive to said differential pressure, allowing ink to flow from the second ink supply to the printhead.

15. An inkjet printing system comprising:

a printhead having a plurality of ink ejection elements;

a first ink supply having a capillary material disposed therein for holding a volume of ink and fluidically coupled with the printhead;

a second ink supply having a volume of ink and fluidically coupled with the printhead, said second ink supply providing ink to the printhead when a differential pressure between the printhead and the second supply exceeds a predetermined pressure; and a electro mechanical valve responsive to said differential pressure, allowing ink to flow from the second ink supply to the printhead.

16. A method for supplying ink to an inkjet printhead, comprising:

providing a first supply of ink having a capillary material disposed therein for holding a first volume or ink therein and fluidically coupled to the printhead;

providing a second supply of ink having a second volume of ink and fluidically coupled to the printhead through an flow path which does not pass through the capillary material in the first supply of ink;

supply ink to said printhead from only said first supply of ink under low rate printing conditions;

supply ink to said printhead from said second supply of ink through said flow path under high rate printing conditions.

17. An ink delivery system for ink-jet printing, comprising:

a printhead including a plurality of ink ejection elements;

a first ink supply having a capillary body disposed therein for holding a first volume of ink and fluidically coupled to the printhead;

a second ink supply for holding a second volume of ink and fluidically coupled to the printhead through a flow path which does not pass through the capillary body in the first ink supply, said second ink supply providing ink to the printhead through the flow path when a differential pressure between the printhead and the second supply exceeds a predetermined pressure;

a flow control device responsive to said differential pressure, allowing ink flow from the second ink supply to the printhead through the flow path, wherein said flow control device is a check valve.

18. An ink delivery system for ink-jet printing, comprising:

a printhead including a plurality of ink ejection elements;

a first ink supply having a capillary body disposed therein for holding a first volume of ink and fluidically coupled to the printhead;

a second ink supply for holding a second volume of ink and fluidically coupled to the printhead through a flow path which does not pass through the capillary body in the first ink supply, said second ink supply providing ink to the printhead through the flow path when a differential pressure between the printhead and the second supply exceeds a predetermined pressure;

a flow control device responsive to said differential pressure, allowing ink to flow from the second ink supply to the printhead through the flow path, wherein said flow control device is a poppet valve.

19. An ink delivery system for ink-jet printing, comprising:

a printhead including a plurality of ink ejection elements;

a first ink supply having a capillary body disposed therein for holding a first volume of ink and fluidically coupled with the printhead;

a second ink supply for holding a second volume of ink and fluidically coupled to the printhead through a flow path which does not pass through the capillary body in the first ink supply, said second ink supply providing ink to the printhead through the flow path when a differential pressure between the printhead and the second supply exceeds a predetermined pressure;

a flow control device responsive to said differential pressure, allowing ink to flow from the second ink supply to the printhead through the flow path, wherein said flow control device is an electro mechanical valve.

20. An ink delivery system for ink-jet printing, comprising:

a printhead including a plurality of ink ejection elements;

a first ink supply having a capillary body disposed therein for holding a first volume of ink and fluidically coupled to the printhead;

a second ink supply for holding a second volume of ink and fluidically coupled to the printhead through a flow path which does not pass through the capillary body in the first ink supply, said second ink supply providing ink to the printhead through the flow path when a differential pressure between the printhead and the second supply exceeds a predetermined pressure, wherein said second ink supply has a second capillary material disposed therein, the second capillary material having a lower capillary that the capillary material in said first ink supply.

* * * * *